US007500326B2

(12) United States Patent
Garavaglia

(10) Patent No.: US 7,500,326 B2
(45) Date of Patent: Mar. 10, 2009

(54) MANUALLY LOADED MAGAZINE PISTOL

(76) Inventor: Louis Garavaglia, 3501 Cordgrass Ct., Melbourne, FL (US) 32934

( * ) Notice: Subject to any disclaimer, the term of this patent is extended or adjusted under 35 U.S.C. 154(b) by 0 days.

(21) Appl. No.: 11/669,417

(22) Filed: Jan. 31, 2007

(65) Prior Publication Data

US 2008/0000129 A1 Jan. 3, 2008

Related U.S. Application Data

(60) Provisional application No. 60/764,518, filed on Feb. 1, 2006.

(51) Int. Cl.
*F41A 3/00* (2006.01)

(52) U.S. Cl. ..... 42/12; 42/50

(58) Field of Classification Search ..... 42/49.01, 42/2, 7, 12, 39.5, 49.02; 89/33.03, 33.1
See application file for complete search history.

(56) References Cited

U.S. PATENT DOCUMENTS

| | | | | | |
|---|---|---|---|---|---|
| 193,906 | A * | 8/1877 | Wood, Jr. | ..... | 42/12 |
| 315,253 | A * | 4/1885 | Davis | ..... | 42/12 |
| 956,430 | A * | 4/1910 | Schmeisser | ..... | 42/7 |
| 956,431 | A * | 4/1910 | Schmeisser | ..... | 42/7 |
| 1,027,893 | A * | 5/1912 | Schmeisser | ..... | 42/12 |
| 1,476,125 | A * | 12/1923 | Wesson et al. | ..... | 42/12 |
| 3,557,482 | A * | 1/1971 | Hoover | ..... | 42/12 |
| 4,914,845 | A * | 4/1990 | Reese et al. | ..... | 42/40 |
| 4,936,035 | A * | 6/1990 | Reese et al. | ..... | 42/70.08 |
| 4,999,939 | A * | 3/1991 | Reese et al. | ..... | 42/40 |
| 5,099,595 | A * | 3/1992 | Chesnut et al. | ..... | 42/50 |
| 5,388,360 | A * | 2/1995 | Fortunato | ..... | 42/50 |
| 6,481,145 | B2 * | 11/2002 | Weichert et al. | ..... | 42/12 |
| 2007/0074437 | A1 * | 4/2007 | Compton et al. | ..... | 42/12 |

* cited by examiner

*Primary Examiner*—Troy Chambers
*Assistant Examiner*—Jonathan C Weber
(74) *Attorney, Agent, or Firm*—John R. Benefiel

(57) ABSTRACT

A pistol accommodating rifle length cartridges in a pistol grip magazine by upwardly angling the cartridges in the magazine. The cartridges are successively chambered manually by exposing the topmost cartridge in the magazine in a feed slot, to allow the user to push that cartridge out of the slot, and the cartridge are guided into the exposed chamber of the barrel which has been pivoted out of the frame to a position to one side of the pistol frame ready to receive the cartridge.

5 Claims, 2 Drawing Sheets

MANUALLY LOADED MAGAZINE PISTOL

CROSS REFERENCE TO RELATED APPLICATIONS

This application claims the benefit of U.S. provisional application Ser. No. 60/764,518 filed on Feb. 1, 2006.

BACKGROUND OF THE INVENTION

The present invention relates to firearms, in particular, it relates to a repeating pistol having a magazine capable of receiving rifle-sized cartridges, which is loaded manually rather than mechanically, thereby reducing the pistol's weight, bulk number of parts, and production costs.

For more than half a century, various attempts have been made to design repeating pistols which accommodate the larger more, powerful cartridges usually associated with shoulder arms. In every case, these attempts have resulted in firearms which are objectionably heavy and bulky, expensive, and, in some cases, mechanically complex as well.

SUMMARY OF THE INVENTION

It is an object of the present invention to provide a magazine equipped pistol, having about the same dimensions as the conventional 0.45 ACP semi-auto pistol, which will allow holding a number of rifle-sized cartridges such as for the AK47, and manually feeding each cartridge successively into the chamber of the pistol. One embodiment of this concept, which in silhouette resembles a conventional semi-automatic pistol, has a barrel pivoted about a vertical axis at the muzzle end, and a magazine cavity defined in a hollow pistol grip. The cartridges are housed in the magazine held at a steep upward angle so as to accommodate the longer length of the cartridges within the limited width of the grip. The breech end of the barrel is able to be swung to one side to expose the chamber for loading. A feed slot extends across the cover of the grip near the top, which allows the user to place his thumb against the base of the topmost cartridge held therein and push it up and out, with guide surfaces guiding it directly into the chamber in the barrel. The guide surfaces are formed on a feed block and feed ramp contoured to direct the cartridge into the chamber as the user pushes the same forward out of the feed slot with the thumb of one hand. After the barrel is pivoted back, the now chambered cartridge is ready for firing using a conventional firing mechanism. After firing, the barrel is pivoted back out, and the spent cartridge is extracted. Another cartridge is in position in the feed block ready to be pushed into the chamber to chamber a fresh round.

BRIEF DESCRIPTION OF THE DRAWINGS

The present invention will be more fully understood by reference to the attached drawings, wherein.

DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1A:
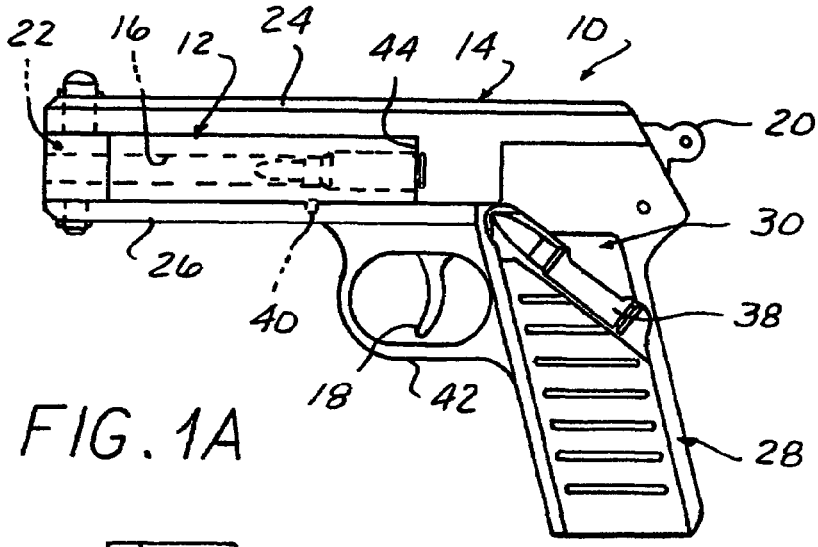
FIG. 1A is a slide elevational view of the pistol shown in FIG. 1 with a stack of cartridges held in the magazine and other cartridge loaded into the chamber.
Figure 2:
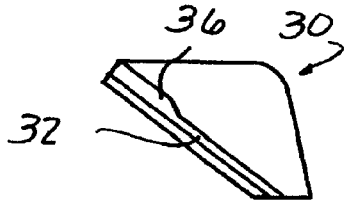
FIG. 2 is a pictorial enlarged view of a feed block included in the pistol shown in FIG. 1.
Figure 1:
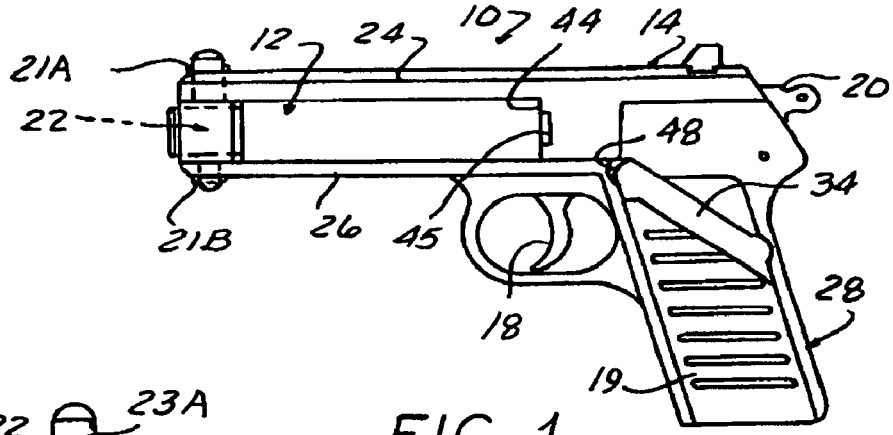
FIG. 1 is a side elevational view of a pistol according to the present invention.
Figure 7:
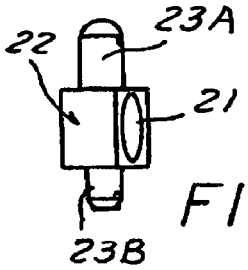
FIG. 7 is a pictorial view of a pivot block included in the pistol as shown in FIG. 1.
Figure 6:
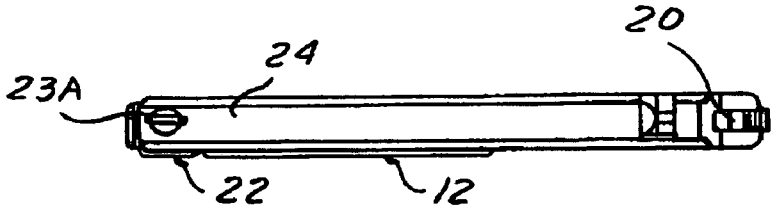
FIG. 6 is a top view of the pistol shown in FIG. 1.

As shown in FIGS. 1 and 2, a pistol 10 includes a barrel 12 and a main frame 14. A downward extending hollow hand grip 28 is provided at the rear of the frame 14 defining a magazine cavity as described below. A trigger 18, hammer 20, and other components of the firing mechanism (not shown) housed in the frame 14 are provided in conventional fashion. The muzzle end of the barrel 12 is threaded into a hole 21 in the pivot block 22, which is mounted to the frame 14 to be rotatable about a vertical axis between an upper frame member 24 and a lower frame member 26 held to the frame with a screw 15. An open space is defined between the members 24, 26 within which the barrel 12 can be pivoted by being pushed from one side by a user of the pistol 10.

The pivot block 22 has oppositely extending axle pins 23A, 23B, each rotatably received in the upper and lower frame members 24, 26 respectively with cross pins 21A, 21B securing the same therein. This arrangement allows the barrel's breech end to be swung out to one side when pushed by the trigger finger of the user, through a horizontal plane, to prepare for loading a cartridge 38.

Figure 3:
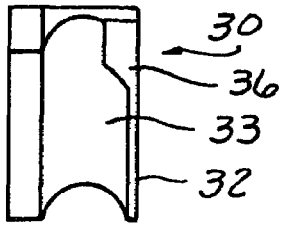
FIG. 3 is a front view of the feed block as shown in FIG. 2.
Figure 8:
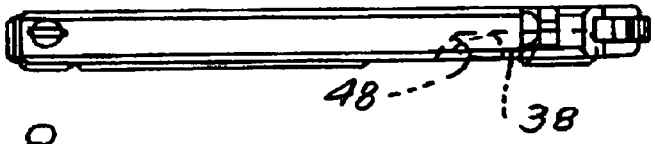
FIG. 8 is a top view of the pistol as shown in FIG. 1 with a cartridge and feed ramp shown in hidden lines.

The lower part of the grip 28 is enclosed by a cover plate 19 which is cut off at the top at an angle to form a feed slot 34. Housed inside the grip 28 at the top, and fixed in place, is a feed block 30 and a feed ramp 48 (see FIGS. 1, 8 and 9). The feed block 30 is contoured much like the top of a conventional double-column box magazine, with feed lip 32, groove 33, and cam surface 36 arranged to shift an uppermost cartridge 38 to the left, as seen in FIG. 3, thereby positioning it to be pushed on the exposed base of a cartridge and also preventing it from escaping laterally. The lower side of the feed block 30 is formed at an angle of about 30 degrees from the horizontal, an upward angle thus assumed by all the rifle cartridges 38 housed inside magazine cavity 27 defined in the grip 28. This allows the much greater length of the cartridges (about 2-¼", or 57 mm.) to be accommodated within a conventionally dimensioned grip which may be held in the usual manner.

Figure 4:
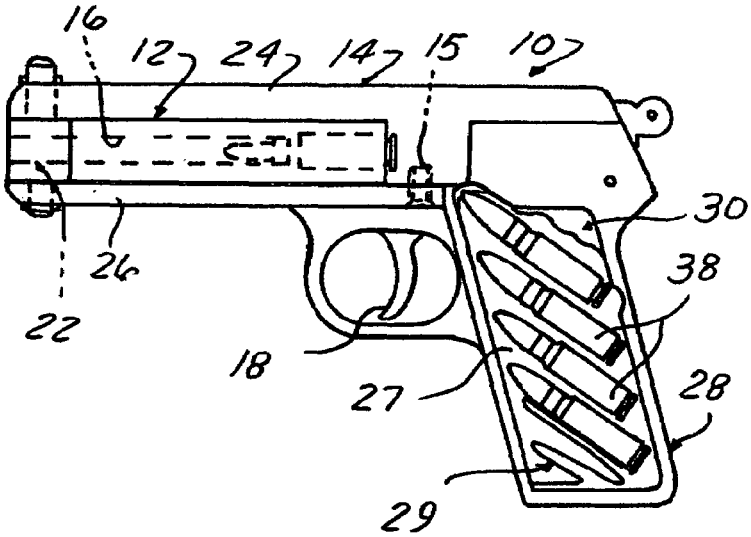
FIG. 4 is a side elevational view of the pistol shown in FIG. 1 with a grip cover plate removed.
Figure 5:
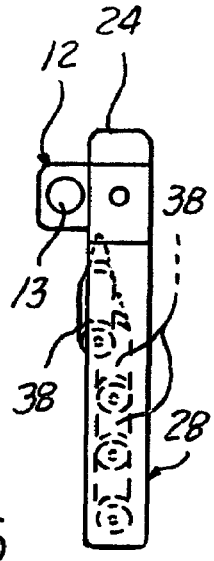
FIG. 5 is a simplified rear end view of the pistol shown in FIG. 4 with certain details omitted for clarity.
Figure 9:
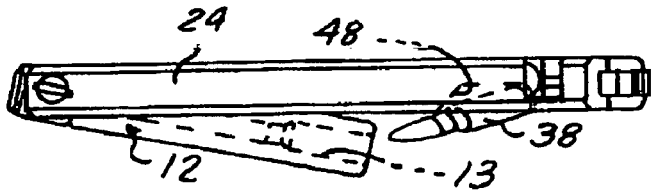
FIG. 9 is a top view of the pistol shown in FIG. 6 with the barrel swung out to the loading position and a cartridge partially advanced from the magazine.

As seen in FIG. 4, the cartridges 38 are stacked in the magazine cavity 27 defined within the grip 28, one above the other, and, in a well known fashion, are urged upwardly by a spring 29. A cam surface 36 on feed block 30 directs the uppermost cartridge to the left, against the confining lip 32 of the groove 33, where its base is exposed to be accessible to the user's thumb, as seen in FIGS. 1A and 5. Advance of a cartridge 38 by a user's thumb push causes it to contact a feed ramp 48 (FIGS. 8 and 9) so that further advance causes angling of the cartridge 38 to the left. This aligns the nose of cartridge 38 with the chamber 13 of the bore 16 formed in the barrel 12. Thus, the cartridge 38 will be guided as it is manually pushed out of the magazine cavity 27 to be advanced into the chamber 13, as seen in FIG. 9. The barrel 12 is thereafter pivoted back into a closed position recessed into the frame cavity, with the protruding cartridge base accommodated by a slot 45 in the breech face 44 (FIG. 1).

The barrel 12 may be held in the closed position by a simple ball detent 40 (FIG. 1A), located to the front of a trigger guard 42 and projecting upward through the lower frame member 24. This detent is adequate because the offset from the center of the barrel pivot block 22 to the center of the breech face 44 is so slight, in relation to the length of the barrel between those points, that a positive lock will not normally be needed. If, however, a positive lock is deemed desirable, then a simple spring-loaded L-shaped arm, pivoting in the front of the trigger guard and engaging a shallow groove in the underside of the barrel, may be included.

Ejection of the fired cases may be effected by any suitable extractor, many of which are known in the art, as, for example, those shown in U.S. Pat. Nos. 46,617; 101,637; or 105,388.

The pistol 10 is used with a two-hand hold. To fire, the shooter first grasps the pistol 10 in his right hand, in the usual manner. When he does so, the feed slot 34 in the wall of the grip 28 will be just below his right thumb. He then wraps his left hand around his right. Again, the feed slot 34 will be just below his thumb, and the top most cartridges 38 aligned with it and now within easy reach of his left thumb. A pull on the trigger 18 fires the pistol 10; the shooter then pushes the barrel 12 to be pivoted to the left with his trigger finger, a move which exposes the base of the fired cartridge to allow an extractor mechanism (not shown) to automatically eject the empty case, the shooter then using his left thumb to push the topmost cartridge 38 disposed in the feed slot 34 forwardly, directly into the chamber 13. Then, still using his left thumb, he presses the barrel 12 to the closed position. Because the shooter's hands change position only slightly, he can perform these motions rapidly. Thus, with practice (and starting with an empty chamber), he can fire four shots in ten seconds or less.

If desired, a sliding thumb-piece (not shown) may be added to the grip 28, adjacent to the feed slot 34, to facilitate the feeding of fresh rounds, especially when wearing gloves. In addition, the barrel can be opened by a flat spring instead of finger pressure, as described in Peck and Farrow's U.S. Pat. No. 1,027,893.

It should be noted that, although this concept is described in connection with a pistol, it can be applied to shoulder arms as well. When applied to shoulder arms, it may be desirable to make the magazine a separate component, which can be attached to, or detached from, the frame of the arm at will. In the case of a 40 mm. grenade launcher with vertically-pivoted, laterally-swinging barrel, such as that presently employed by the U.S. Army, and described in U.S. Pat. No. 6,481,145, the magazine (or magazines) may be conveniently carried on the soldier's belt, and, when needed, readily attached to the frame of the launcher. When attached, the magazine will occupy approximately the same position in relation to the breech end of the barrel as does the fixed magazine in the pistol grip, and so allow reloading by a simple push of the thumb, as in the pistol.

The invention claimed is:

1. A firearm including:

a frame having an attached depending hand grip at a rear end thereof;

a barrel defining a bore and chamber at a rear end of said barrel configured to receive a cartridge; said barrel normally aligned with said frame with said chamber positioned against a breech surface but pivotally mounted to said frame so as to enable said barrel to be swung out away from said breech surface to one side of said frame, so as to expose said chamber by positioning said chamber away from said breech surface and to one side of said frame;

a cartridge magazine attached to said frame having a cavity in which a stack of cartridges may be held; an opening slot at the top of said magazine exposing an uppermost cartridge so as to enable manual pushing of said uppermost cartridge out of said magazine cavity; and guide surfaces guiding said pushed cartridge upwardly and to said one side of said frame so as to be directed into said exposed chamber with said barrel swung out away to said one side of said frame when said pushed cartridge is continued to be advanced to thereby be seated in said chamber.

2. The firearm according to claim 1 wherein a pivot block is rotatably mounted to a forward end of said frame, said barrel connected at a forward end to said pivot block.

3. The firearm according to claim 2 further including a detent releasably locating said barrel in position aligned with said frame.

4. The firearm according to claim 1 wherein the cartridge magazine further includes an angled feed block having a bottom surface angled upwardly and engaging a cartridge in said magazine to cause an upwardly inclined orientation of said cartridges in said magazine cavity.

5. A method of loading successive cartridges into a chamber formed in the barrel of a firearm comprising:

stacking cartridges vertically in a magazine in a firearm grip;

urging said cartridges upwardly in said magazine with spring pressure to thereby position an uppermost cartridge in a slot formed at the top of said magazine against a stop which is angled with respect to said magazine so that said uppermost cartridge is disposed at a steep angle in said firearm grip;

exposing the uppermost cartridge positioned against the stop to allow manual engagement by a user of the firearm;

pivotally mounting said barrel of the firearm so as to allow said barrel to be swung laterally away from a position with said chamber immediately forward of a breech surface and expose said chamber formed in said barrel to one side of said breech surface; and guiding said uppermost cartridge so as to direct said uppermost cartridge from said magazine into said exposed chamber upon pushing a base of said cartridge to advance said uppermost cartridge out of said magazine and into said exposed chamber.

* * * * *